US006918694B2

(12) United States Patent
Speichinger et al.

(10) Patent No.: US 6,918,694 B2
(45) Date of Patent: Jul. 19, 2005

(54) CONTROL MECHANISM FOR THE SETTING DEVICES OF A WATCH AND WATCHES INCORPORATING SUCH A MECHANISM

(75) Inventors: Ferdinand Speichinger, Jestetten (DE); Denis Zimmermann, Kleinandelfingen (CH)

(73) Assignee: Richemont International SA, Villars-sur-Glane (CH)

( * ) Notice: Subject to any disclaimer, the term of this patent is extended or adjusted under 35 U.S.C. 154(b) by 288 days.

(21) Appl. No.: 10/366,413

(22) Filed: Feb. 14, 2003

(65) Prior Publication Data

US 2003/0151984 A1 Aug. 14, 2003

(30) Foreign Application Priority Data

Feb. 14, 2002 (EP) ..... 02003420
Jan. 25, 2003 (EP) ..... 03001679

(51) Int. Cl.[7] ..... G04B 27/02; G04B 17/00; G04B 19/22; G04B 27/00

(52) U.S. Cl. ..... 368/190; 368/22; 368/31; 368/184

(58) Field of Search ..... 368/21, 22, 25–27, 368/31–40, 76–78, 184–199

(56) References Cited

U.S. PATENT DOCUMENTS 5,339,293 A * 8/1994 Kamiyama et al. ..... 368/21
5,339,297 A * 8/1994 Suzuki et al. ..... 368/321
6,134,186 A 10/2000 Jang
6,185,158 B1 * 2/2001 Ito et al. ..... 368/37

FOREIGN PATENT DOCUMENTS

| | | | |
|---|---|---|---|
| CH | 54533 | 2/1911 | |
| CH | 287290 | 3/1953 | |
| CH | 664 468 | 3/1988 | |
| CH | 665 930 G A3 | 6/1988 | |
| CH | 665930 * | 6/1988 | ..... 368/22 |
| CH | 674 290 | 5/1990 | |
| CH | 685965 /G A3 | 11/1995 | |
| DE | 29 921 496 | 6/2000 | |
| EP | 0 558 756 B1 | 1/1997 | |
| FR | 2 672 399 | 8/1992 | |

* cited by examiner

*Primary Examiner*—Randy W. Gibson
*Assistant Examiner*—Michael L. Lindinger
(74) *Attorney, Agent, or Firm*—Young & Thompson

(57) ABSTRACT

A control mechanism adapted to be incorporated into a watch with a main setting device, which comprises at least two engagement positions, namely one rest position and at least one pulled position, and with at least one auxiliary setting device. The invention is also concerned with all types of watches suitable for the integration of such a control mechanism and comprising the mechanism, in particular a world time watch with an analogue indication of the time of the day and of a corresponding location for different time zones with an offset relative to the local time by a multiple of an hour or of half an hour, which thus allows a simultaneous and reliable reading of the time of the day for the indicated time zones and which, in particular, avoids inadvertent modification of the settings of the watch.

19 Claims, 11 Drawing Sheets

CONTROL MECHANISM FOR THE SETTING DEVICES OF A WATCH AND WATCHES INCORPORATING SUCH A MECHANISM

BACKGROUND OF THE INVENTION

The present invention is concerned with a control mechanism adapted to be incorporated into a watch with a main setting device, which comprises at least two engagement positions, namely one rest position and at least one pulled position, and with at least one auxiliary setting device, as well as with all types of watches suitable for the integration of such a control mechanism and comprising said mechanism, in particular a world time watch with an analogue indication of the time of the day and of a corresponding location for different time zones with an offset relative to the local time by a multiple of an hour or of half an hour and thus allowing a simultaneous and reliable reading of the time of the day for the indicated time zones.

Watches of this type have been available since the introduction of world time zones, following the Meridian Conference in Washington/USA, in 1884, in different versions with respect to their design and to their functioning. These watches often include, in addition to their centrally rotating minutes hand and hour hand, at least one further hand, which indicates the time in the selected time zone. Some of these watches provide means for identifying the displayed time zone, for example such as by permanent inscriptions on the dial, a rotatable ring with inscriptions of the world locations or the like.

Thus, for example, patent FR 2 672 399 discloses a world time watch with an additional analogue display which indicates the time of the day for a time zone different from the local time. This watch can further include an additional concentric hand which indicates a locality representing the time zone selected and which can be set into different positions by means of a pusher. However, this embodiment is not suitable for displaying additional time information of several time zones.

Patent CH 665 930 describes a world time watch with at least one additional display, the additional time of the day information being indicated in that case by three auxiliary dials, which are arranged non-concentrically with respect to the main dial and which include each an hour hand which undergoes a full rotation in 24 hours. Each one of these additional time displays includes a location display in the form of a world location disc similar to a date disc as well as a separate crown which can occupy two positions. The latter enables the user in its pulled position to select simultaneously, but independently of the other time displays, the time of the day and the locality corresponding to the selected time zone in the corresponding additional display. Furthermore, this watch includes a main crown with three positions, namely the rest position for winding up the watch, a pulled position for setting the time displays of the main dial or, in case a pusher is operated, of all dials, and an intermediate position for setting the date. However, the setting, in particular that of the additional time displays, is complicated and time consuming due to the fact that it is carried out by means of crowns.

Patent EP 0 558 756 is directed to a world time watch with at least one additional analogue display for giving the time of the day in different world time zones. Again, auxiliary dials are provided, which are arranged non-concentrically with respect to the central main dial, and a crown with three positions allows to wind up the watch, to reset the date and to reset the time of the day in all the time displays in its non pulled position respectively in the first and in the second pulled positions. In order to simplify the setting of the additional time displays, these are each provided with a pusher, that latter one changing the time of the additional time displays by one hour steps each time it is pressed. However, the absence of location indicators corresponding to the additional time displays, which could allow the identification of each indicated time zone, renders it difficult to read the time information for a given time zone, in particular due to the presence of several additional displays. Furthermore, the pushers can be operated any time, which can easily lead to an involuntary modification of a time indication.

However, none of the embodiments described provides an easy and an effective control of the different setting devices of these complex watches, which can lead in case of simultaneous operation of the different functions of the watch to an involuntary modification of the indications or even to damages of the clockwork-movement.

SUMMARY OF THE INVENTION

The object of the present invention is to overcome the above-mentioned drawbacks and to provide a control mechanism which allows to control with respect to each other the main setting device and the auxiliary setting devices in such a manner that the functions of the main setting device, with the exception of the winding up of the watch in its rest position, cannot be carried out simultaneously with those of the auxiliary setting devices, and, accordingly, to provide watches which incorporate this control mechanism, in particular a world time watch with an analogue indication of the time of the day and of a corresponding location for different time zones with an offset relative to the local time by a multiple of an hour or of half an hour, which allows to read simultaneously and reliably the time of the day in the indicated time zones, which allows an easy, fast and reliable operation and setting, and which, in particular, avoids inadvertent modification of the settings of the watch.

Accordingly, the subject matter of the present invention is a control mechanism having the characteristic features set out herein as well as the watches defined herein.

BRIEF DESCRIPTION OF THE DRAWINGS

The appended drawings illustrate, by way of example, an embodiment of a world time watch incorporating this control mechanism as well as an embodiment of said control mechanism itself according to the present invention.

Figure 9A:
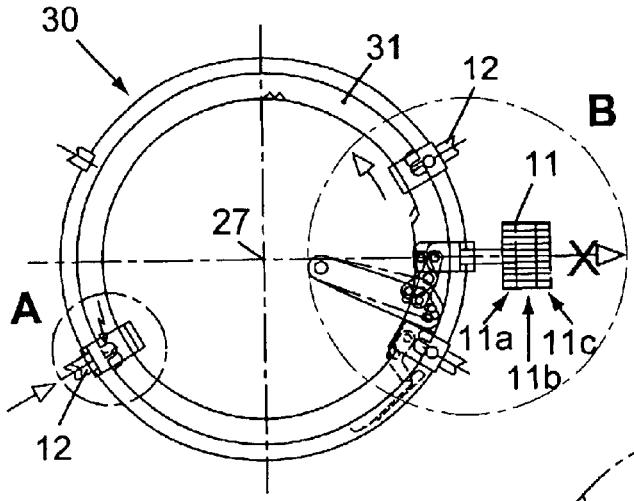
Figure 9B:
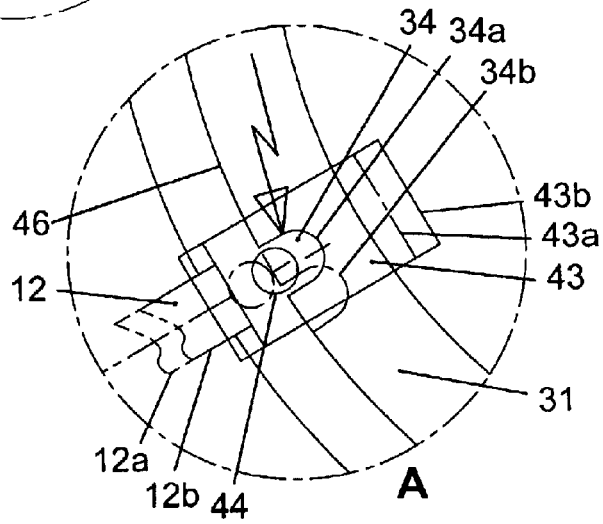
Figure 9C:
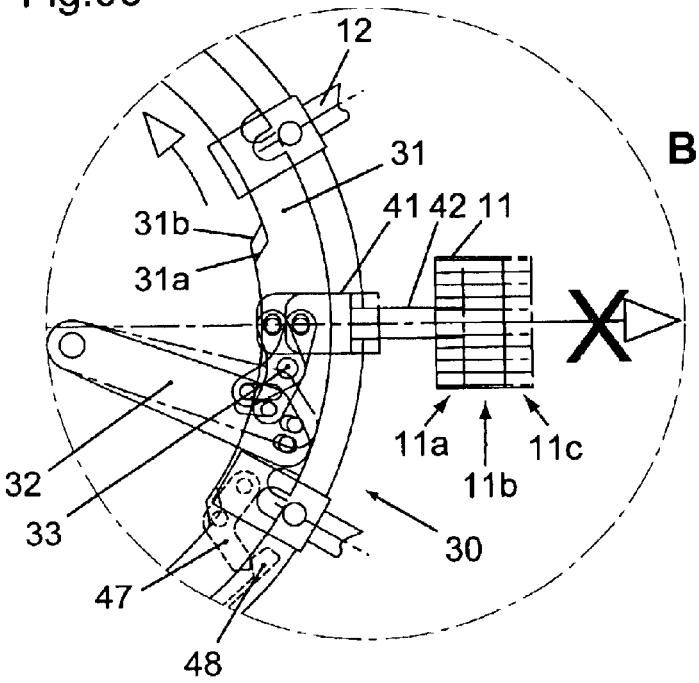

The FIGS. 9*a–c* are schematic views of the control mechanism for the operating elements.

Figure 10A:
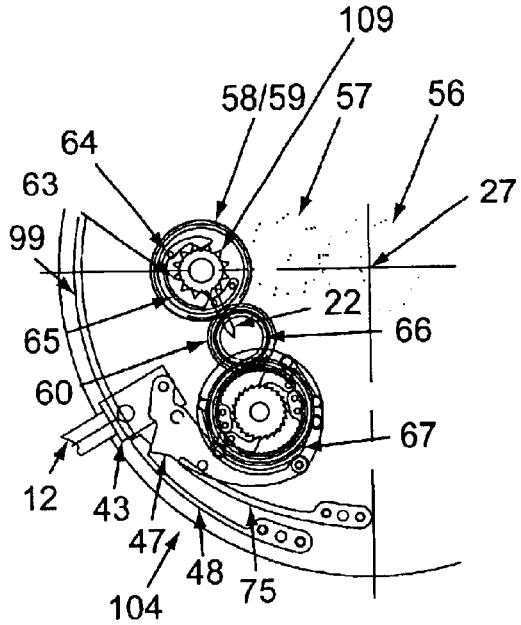
Figure 10B:
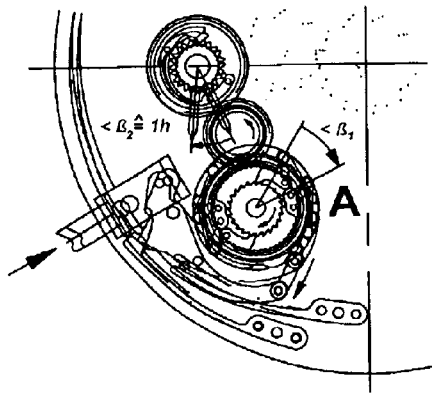
Figure 10C:
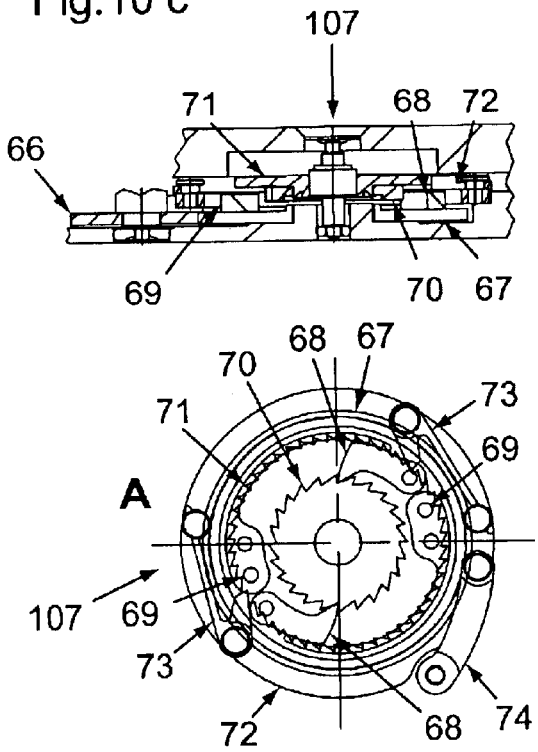

FIGS. 10*a–c* illustrate the mechanism for the hour correction of an auxiliary time display.

Figure 11A:
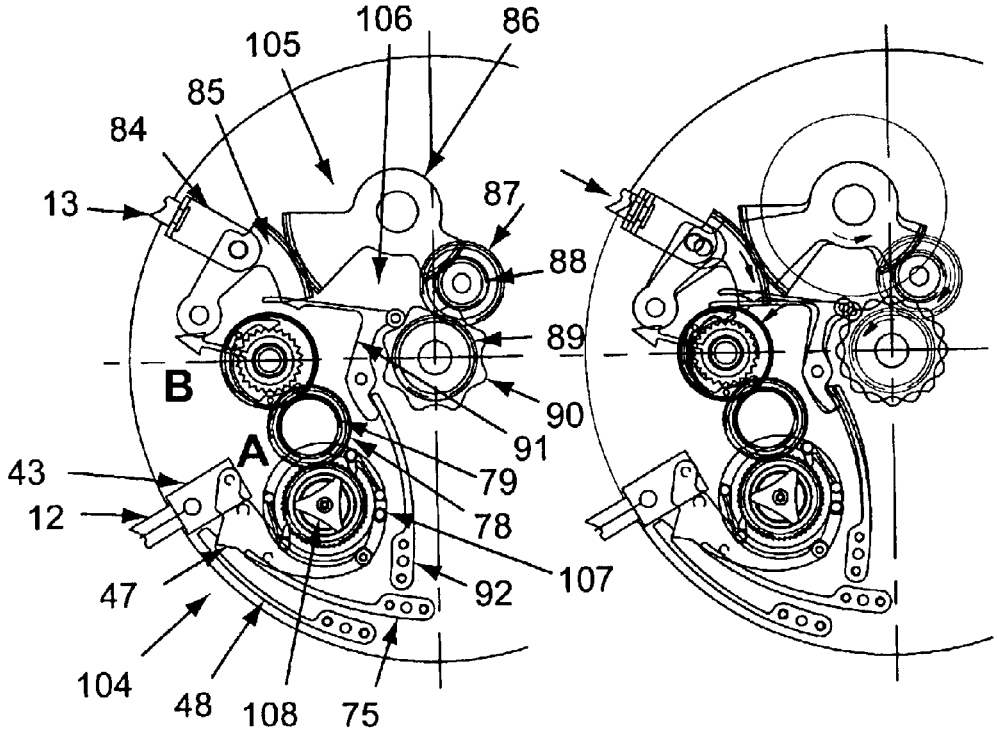
Figure 11B:
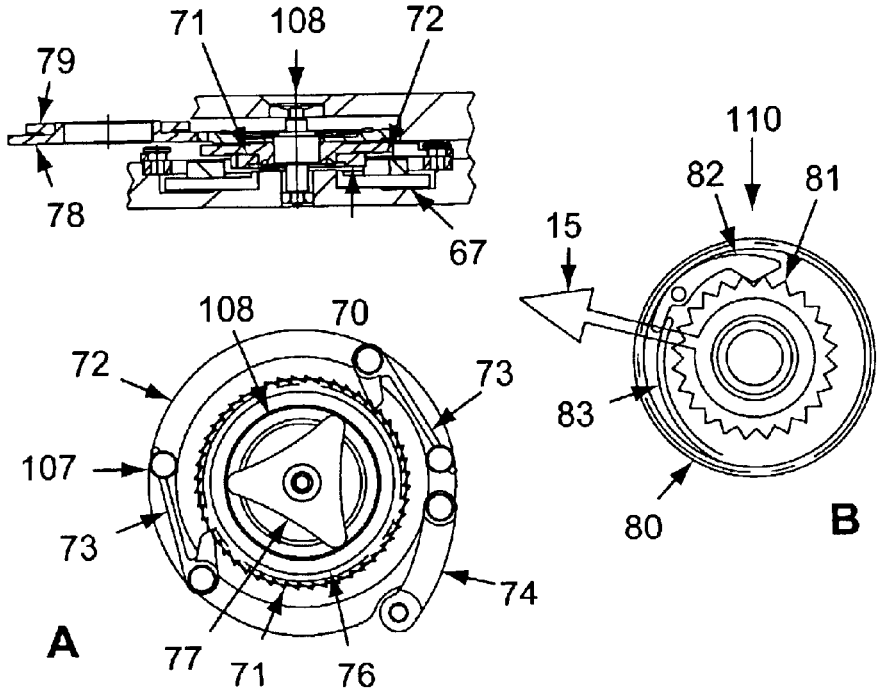

FIGS. 11*a–b* illustrate the mechanism for the choice of a world location in an auxiliary time display.

Figure 12A:
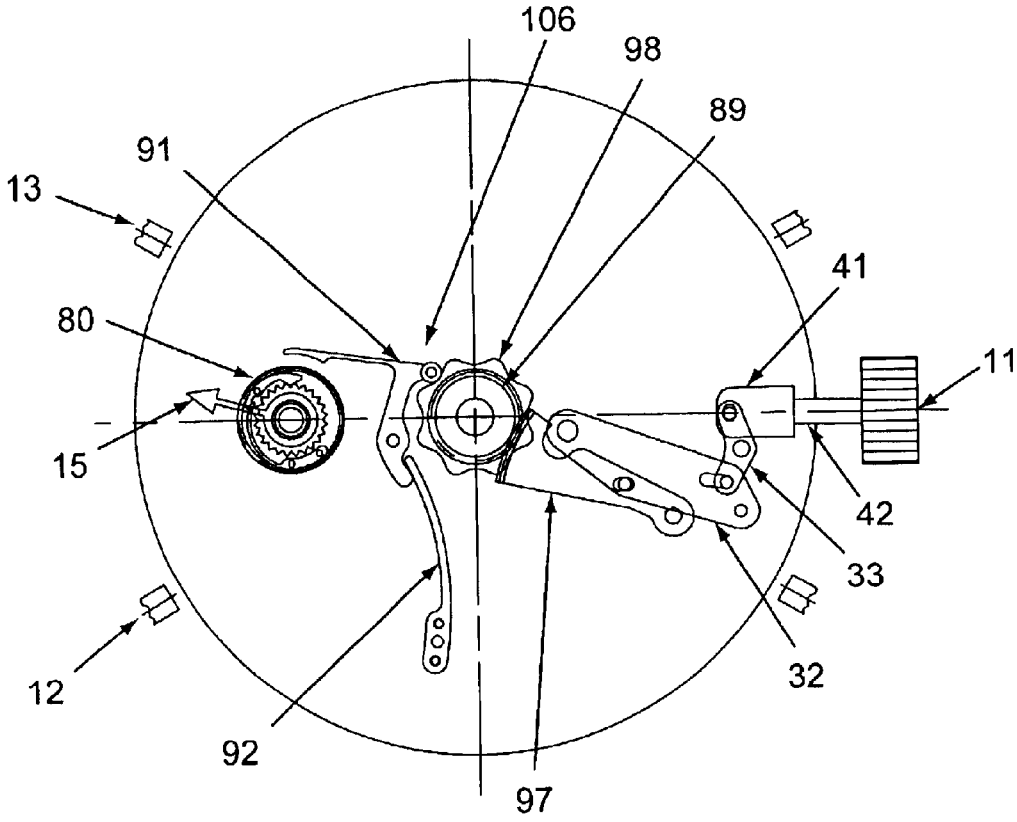
Figure 12B:
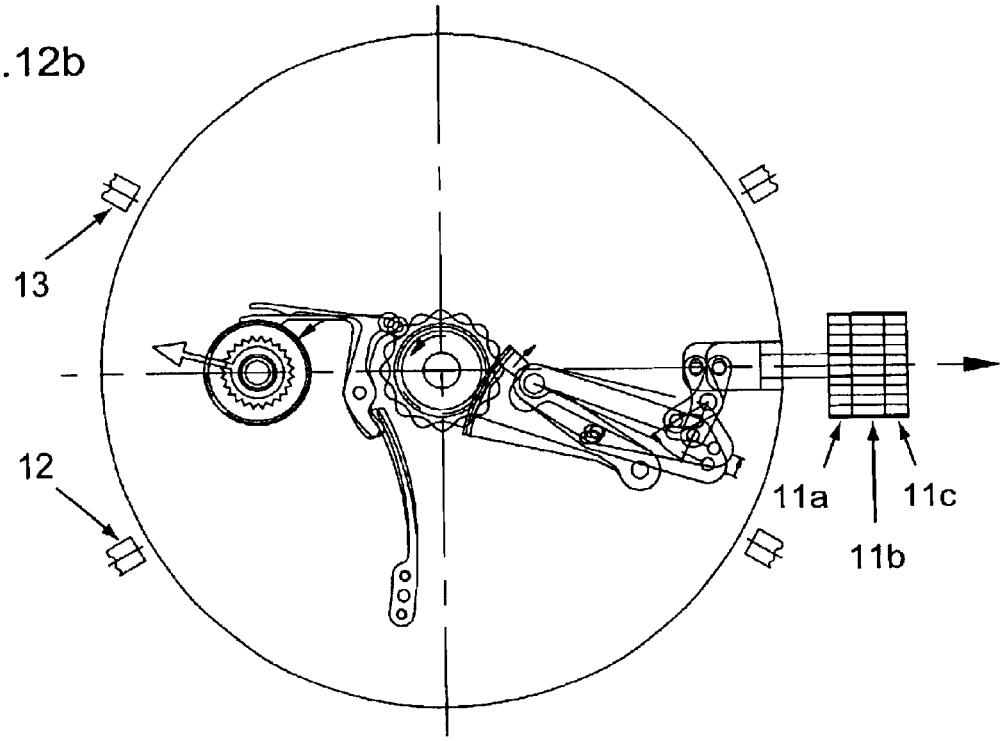

FIGS. 12*a–b* illustrate the blocking mechanism for the world location hands in co-operation with the crown.

DETAILED DESCRIPTION OF THE PREFERRED EMBODIMENTS

The invention will now be described in detail with reference to the appended drawings which illustrate, by way of example, an embodiment of the invention.

Figure 1:
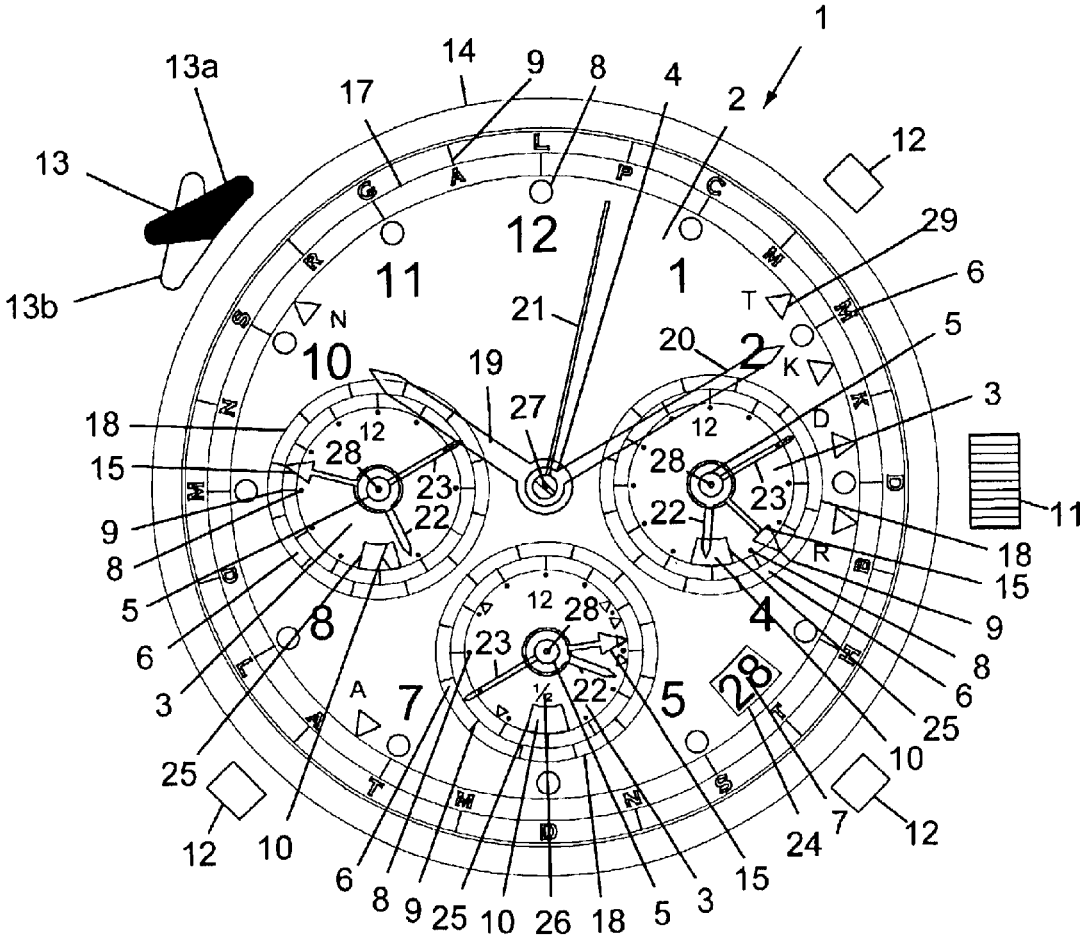
FIG. 1 is a schematic view of the world time watch with a main display and three additional auxiliary time displays as well as with the corresponding hands and operating elements.

The world time watch 1 illustrated in FIG. 1 is characterised by a modular construction. In the example described, a mechanical module situated underneath a main dial for indicating different time zones and eventually other displays comprises most of the functions of the watch. It is mounted as a separate clockwork-movement on a base movement, which may be a mechanical, a quartz-controlled or an automatic quartz-controlled base movement, thus the following descriptions are valid for all possible combinations and versions.

As can be seen in FIG. 1, the centre of a main dial 2 carries an analogue main time display 4 with an hour hand 19, a minute hand 20 and a second hand 21. The hour hand 19 performs two full rotations per day around the main dial 2 having preferentially a 12-section-division 8. The second hand 21 of the main display is optional. Usually, the main time display 4 gives the local time. However, it can also indicate the time in any other location of the world, which is important for the user. Another optional feature is a date indicator 7, which is visible through a date window 24 located in the present case in the main dial 2, that window being positioned at a certain distance from the centre 27 of the main dial 2 and at an with respect to the other display elements appropriately, otherwise freely selected angle. As usual, the date change occurs with the main time display 4 at midnight. Furthermore, a world location ring 17 of the Réhaut type is situated at the outer circumference of the main dial 2, important world locations 6 or appropriate abbreviations each representing a time zone being placed in a 24-section-division 9 of the ring 17.

Several, three in the exemplary case described here, auxiliary dials 3 are arranged non-concentrically on a circle around the centre 27 of the main dial 2, its centres 28 preferably being, at least on one side, at an equal angular distance from one another. The auxiliary dials 3 each have a 12-section-division 8 and comprise a world location ring 18 with different world locations 6 being arranged in a 24-section-division 9 of that ring 18, which both may be designed in different manners as is the case for the main dial 2. Each one of these auxiliary dials 3 serves as analogue auxiliary time display 5, which comprises an hour hand 22 performing two rotations per day and a minute hand 23 in order to indicate the time of the day as well as a world location hand 15, which is at rest during usual functioning of the watch and which can be actuated by means of a setting device 12 by 24 steps for one rotation, in order to identify the indicated time zone. Optionally, an auxiliary time display 5 may include a day-night-indicator 10. In that case, for example a disc divided into six sectors performs a full rotation in 72 hours underneath the auxiliary dial and indicates the user through a night-day-window 25 the onset of the morning or of the evening. The auxiliary dial 3 could also comprise a 24-section-division in order to indicate the time in the indicated time zone as an absolute value. Accordingly, the time in any selected time zone of the world, which is offset by a multiple of an hour from the local time, may be indicated while allowing at the same time an easy identification of said time zone.

In order to give the time of the day in a time zone offset by a multiple of half an hour, the main dial 2 and, if desired, some of the auxiliary dials 3 comprise marked indices 29 for the existing half an hour time zones at a $1/48^{th}$-shift with respect to the 24-section-division 9 inside the world location rings 17 and 18. Letters representing the world locations inside these half an hour time zones may be placed next to the indices 29. A minute hand 23 which otherwise isn't needed becomes necessary in such a auxiliary time display 5 because this minute hand is offset relative to the one of the main time display 4 by half an hour. In order to ensure a better readability, the world location hand 15 of an auxiliary time display for half an hour time zones is designed differently and its auxiliary dial 3 is marked by a corresponding symbol 26, i.e. <<½>>. In FIG. 1 for instance, one of the auxiliary time displays 5 is shown as a display for half an hour time zones.

The hour hands 19, 22 of all the time displays 4, 5 rotate in a synchronised manner when the watch functions normally, thus indicating in correspondence to the chosen location the hour of the day in a given time zone. The minute hands 20, 23 of all the time displays also rotate in a synchronised manner, except that the minute hand 23 of an auxiliary time display 5 for half an hour time zones is offset by 180° relative to the minute hand 20 of the main time display 4. Also, the minute hand 23 of an auxiliary time display 5 for full hour time zones may be suppressed due to the concordance with the minute hand 20 of the main time display 4. Additionally, the day-night-indicators 10 rotate in a synchronised manner. The world location hands 15 do not rotate during normal functioning of the watch, but can be rotated manually using a mechanism which will be described later.

The analogous design of the main dial 2 and of the auxiliary dials 3, facilitates the reading of the smaller auxiliary dials, the referencing of a world location 6 to an auxiliary dial 3 by means of the world location hands 15 and of the world locations ring 18 allows the unequivocal identification of the indicated time zone, and the day-night-indicator 10 gives an indication of whether the selected world zone is in the morning, evening, day or night period.

Before describing in detail the other important components of the world time watch according to the present invention, the functioning and the terminology of the gear train of the mechanical module used for the analogue indication shall first be introduced in the following. Since the subject matter of the invention is primarily directed to the display and operating elements of the world time watch, only the basic components of the gear train will be described in this section.

Figure 4:
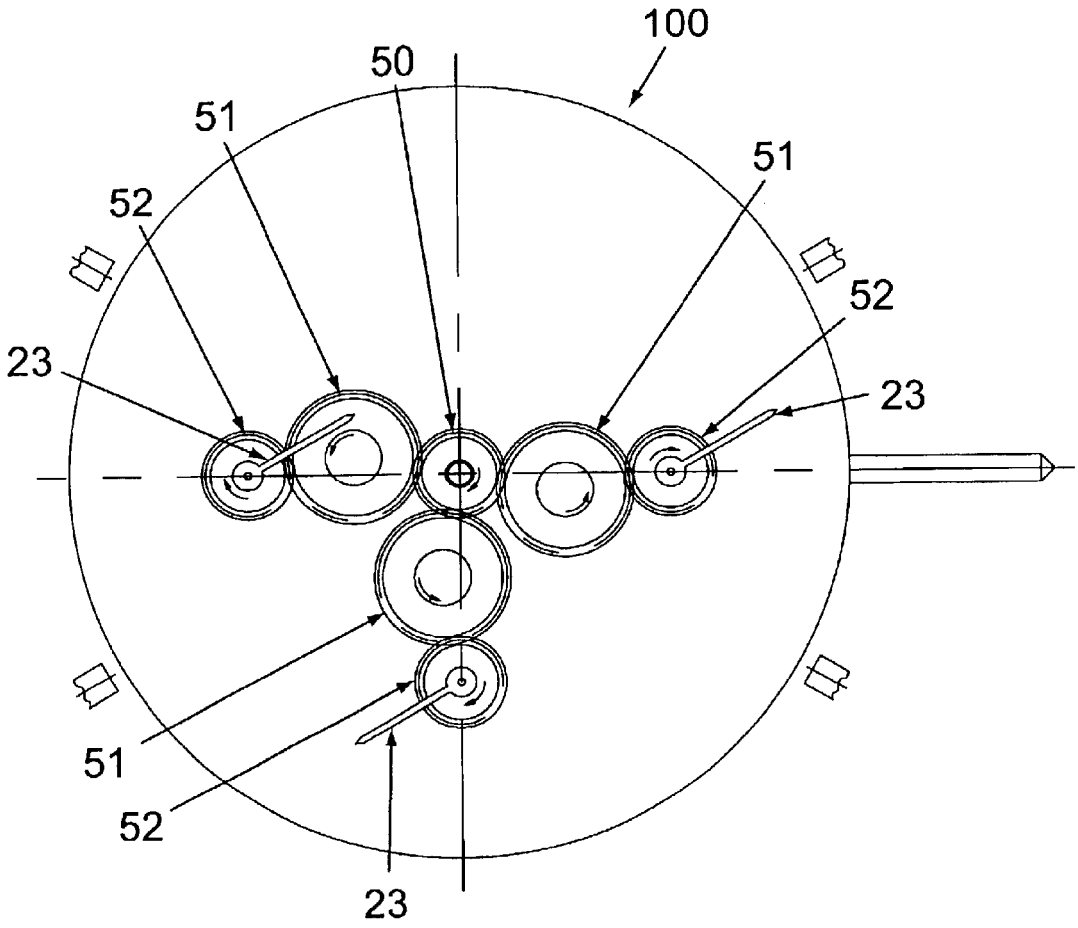
FIG. 4 illustrates in a simplified manner the gear train of the minutes indication.

When considering FIG. 4, one recognises the main components of the gear train of the minute indicator 100. The direction of rotation of the mutually engaged wheels is schematically indicated by arrows. A minute pinion wheel 50, on the one hand side, drives via intermediate minute wheels 51 a respective minute wheel 52 of each auxiliary time display 5 which carries the corresponding minute hand 23 of the auxiliary time display 5 and, on the other side, is fixed to a (not illustrated) minute pinion which carries the minute hand 20 of the main time display 4.

Figure 5A:
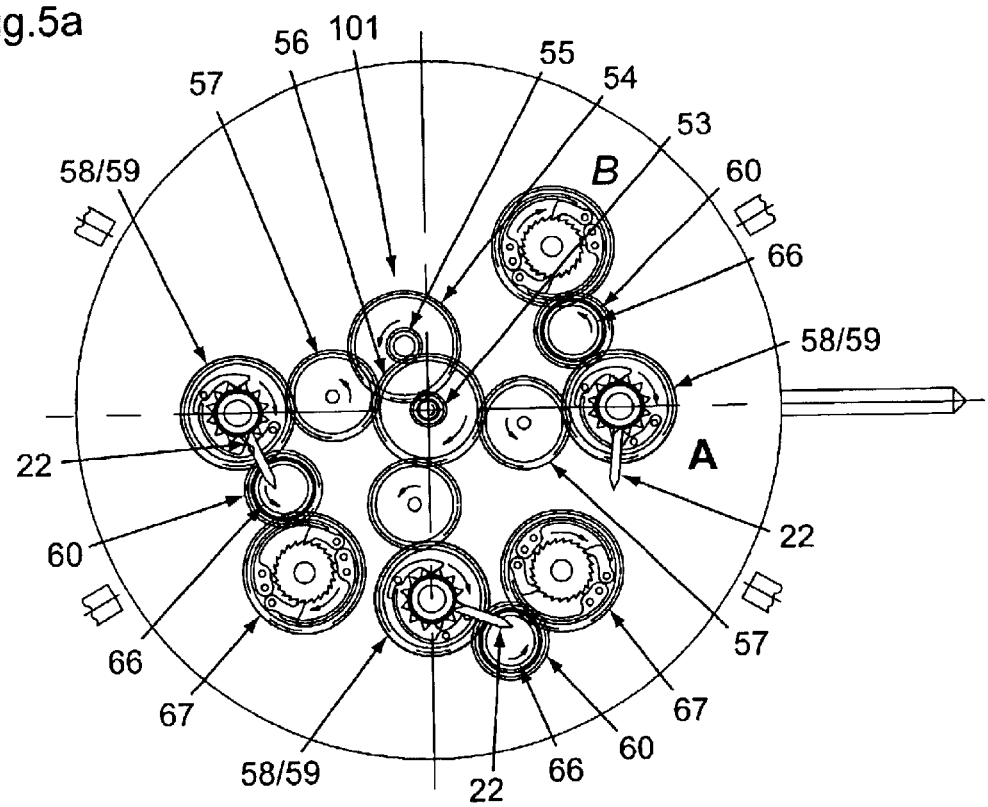
FIGS. 5*a–c* illustrate the gear train of the hour indication.
Figure 5B:
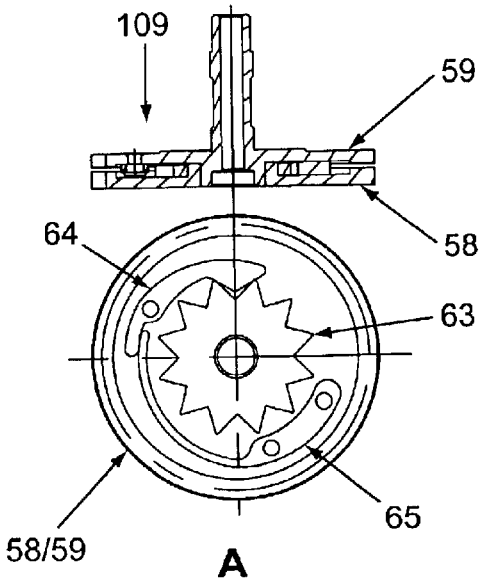
Figure 5C:
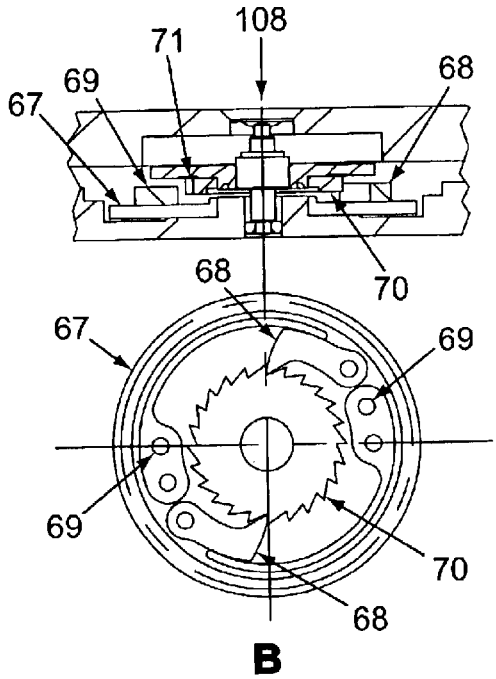

FIG. 5 represents in detail the gear train of the hour indicator 101, wherein the minute pinion 53 is engaged with a speed changing wheel 54 and the latter drives via a speed changing wheel drive 55 an hour wheel 56 of the main time display 4, which carries the hour hand 19 of the main time display 4. The hour wheel 56 of the main time display 4 drives via a respective intermediate hour wheel 57 an hour wheel 58 of an auxiliary time display 5 with an hour indication wheel 59 carrying the hour hand 22 of the auxiliary time display 5. In each auxiliary time display 5, this hour indication wheel 59 is connected by force-traction to the hour wheel 58 of the auxiliary time display 5 by a coupling of the hour display 109, which is comprising a star 63, a pawl 64 and a spring 65. Furthermore, an hour change wheel 60 and a correction change wheel 66 are rotating freely in a synchronised manner in each auxiliary time display 5 during normal operation of the watch, said wheels being engaged with the hour indication wheel 59 respectively the hour wheel 58 of the auxiliary time display 5, as well as a correction wheel 67 which is engaged with the correction change wheel 66. The latter is possible because, as illustrated in FIG. 5*c*, each correction wheel 67 can co-operate with a respective first click wheel 70, pawls 68 which are laterally softly urged against each click wheel 70 by a spring 69 being adapted to slide along that click wheel 70. As will be explained later, these first click wheels 70 are effective only during a correction and remain at rest during the normal functioning of the world time watch 1. For that purpose, the correction wheel 67 comprises, as will be described in more detail in relation to FIGS. 10*c* and 11*b*, a double coupling 108 which is capable of receiving and transmitting two opposite motions, namely the motion along the normal movement of the watch and the one of a correction in the opposite direction. These two couplings are known pawl-saw-teeth-systems and are mounted in opposition in order to allow the transmission of the motion, depending on its origin, in the one or in the other direction.

Figure 6:
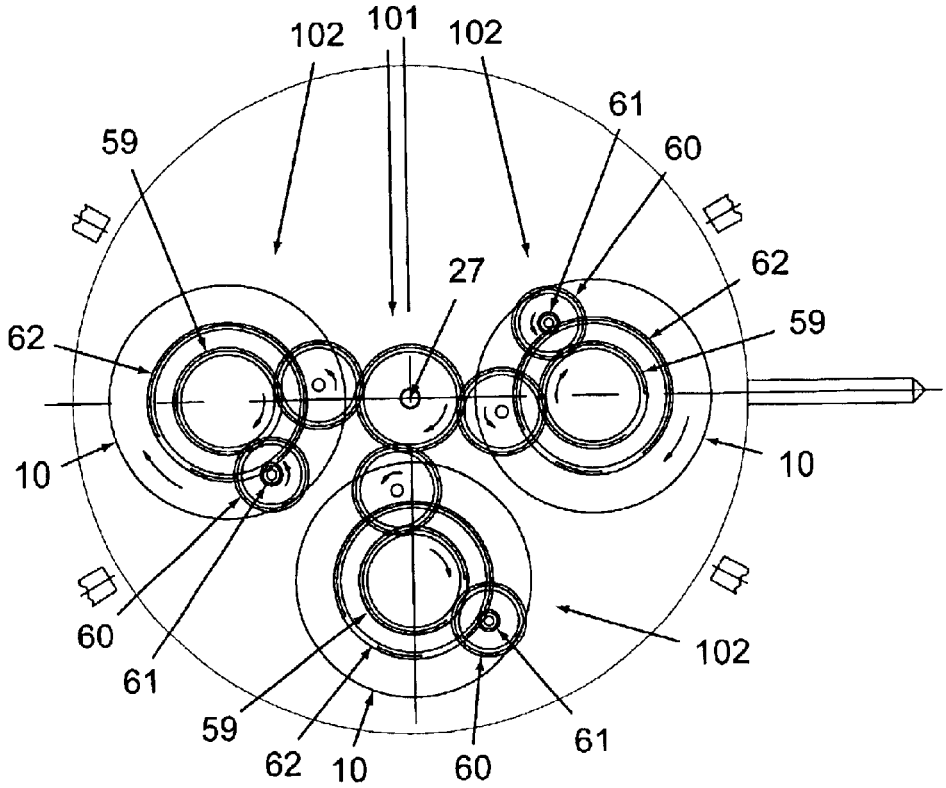
FIG. 6 illustrates the gear train of the day-night-indication.

The day-night-indicator 10 of each auxiliary time display 5 is rigidly fixed to a day-night indicator wheel 62 and the latter—as apparent from FIG. 6 illustrating the gear train of the day-night-indicator 102—is driven via an hour change wheel drive 61, which is connected to the hour change wheel 60, in synchronisation with the hour indicator wheel 59 of the corresponding auxiliary time display 5.

Figure 7:
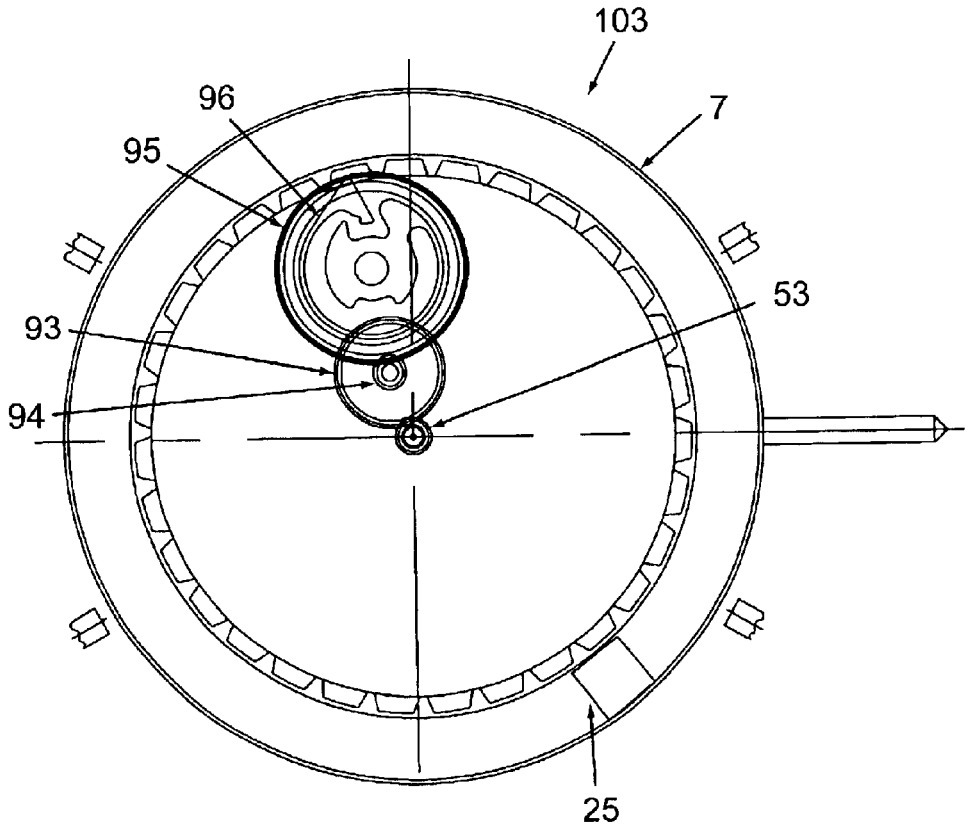
FIG. 7 is a view of the gear train of the date indication.

The date indicator 7 is driven in a known manner by a gear train of the date display 103 illustrated in FIG. 7. The minute pinion 53 drives a date change wheel 93, which co-operates with the date change wheel drive 94, which is further engaged with the date switching wheel 95. This wheel performs a full rotation in 24 hours and thus moves once a day, through the action of a switching finger 96 attached thereto and the teeth on the inner side of the date indicator 7, the latter one by a $1/31^{st}$ of a rotation about its axis.

A world time watch 1 according to the present invention further comprises a series of operating and setting elements, which will now be described in detail with reference to FIGS. 2*a–c* and 3*a–b*.

Figure 2A:
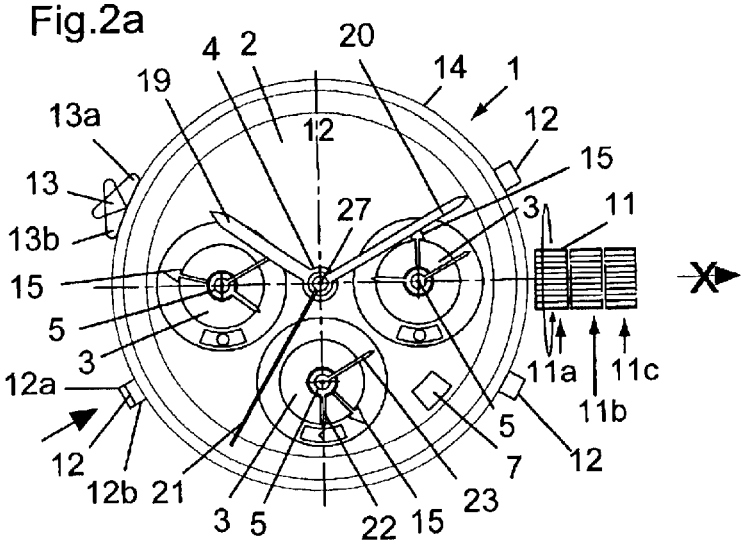
FIGS. 2*a–c* schematically illustrate the operating elements of the world time watch, in particular the crown, in its different positions.
Figure 2B:
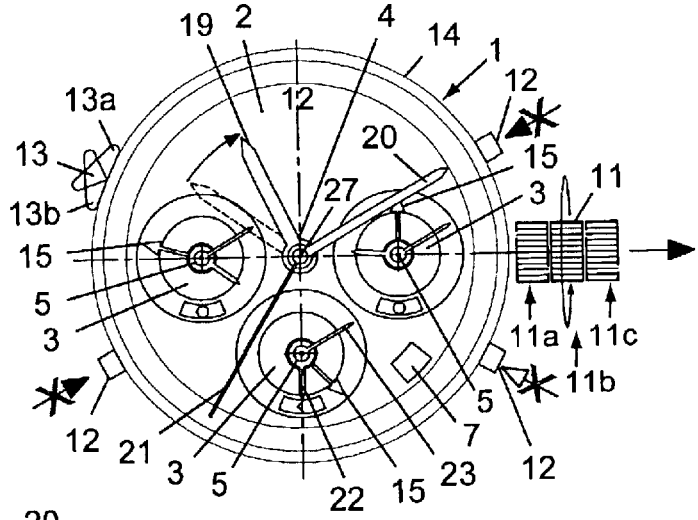
Figure 2C:
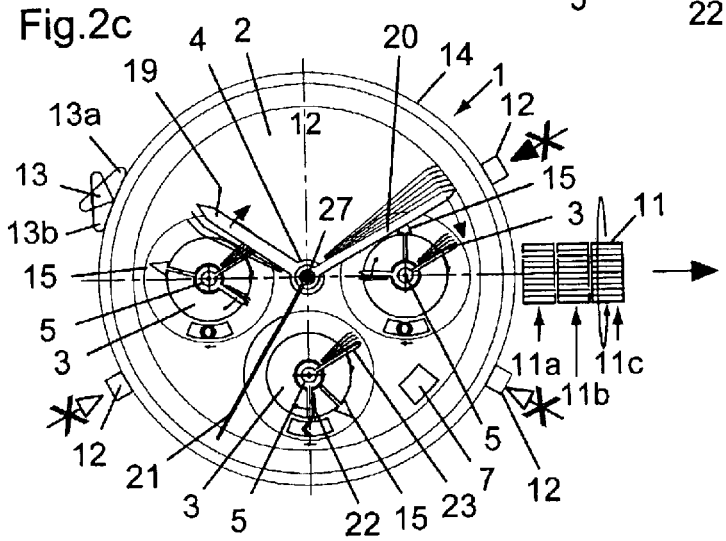

A main setting device in the form of a crown 11 protruding from the outer side of the housing 14 can assume three engagement positions. A non pulled rest position 11*a* allows the winding up of the clockwork-movement as illustrated schematically by the arrows of FIG. 2*a*. The first pulled position 11*b* is used for the correction of the hour indication and of the date indication of the main time display 4 by steps of hours in both directions of rotation, as illustrated in FIG. 2*b*. Accordingly, the hour hand 19 of the main time display 4 performs independently of the minute hand 20 a full rotation in twelve steps, which enables a fast and convenient setting of the hour of the day, for instance in order to change the time of the day at the change from summer time to winter time or eventually when changing to another time zone. Moreover, a forward and backward movement of the hour hand 19 of the main time display 4 around the 12 hour position in this position of the crown 11 switches the date indicator 7 onwards by one step, which allows for a fast date setting. A second pulled position 11*c* is used for the precise adjustment in the main time display up to the seconds, the rotation of the crown 11 in that position, again in both directions, causing a synchronised motion of the hour and minute hands of all the time displays 4, 5, as illustrated in FIG. 2*c*.

Figure 3B:
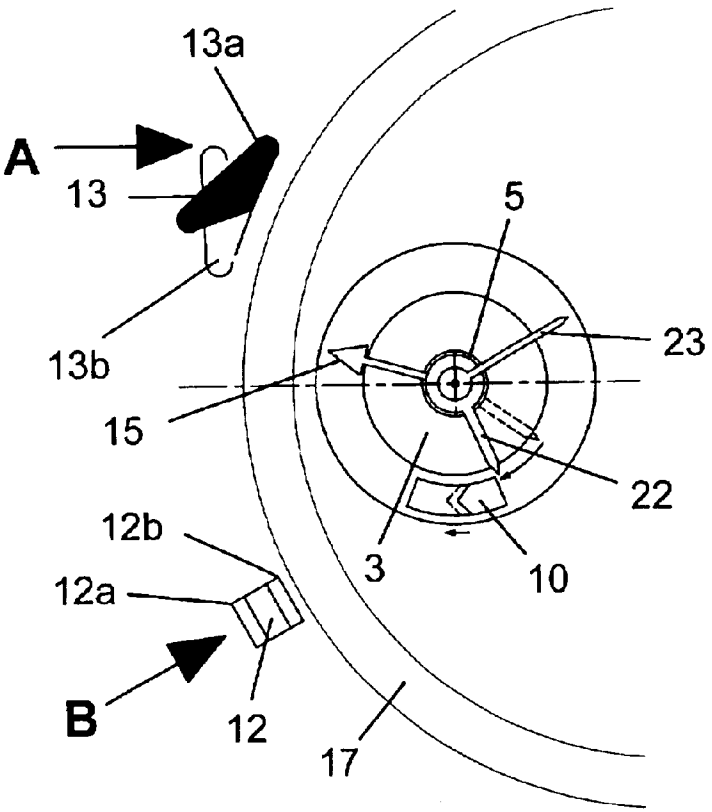
FIGS. 3*a* and 3*b* explain the principle of the choice of the world location and of the hour correction of an auxiliary display.
Figure 3A:
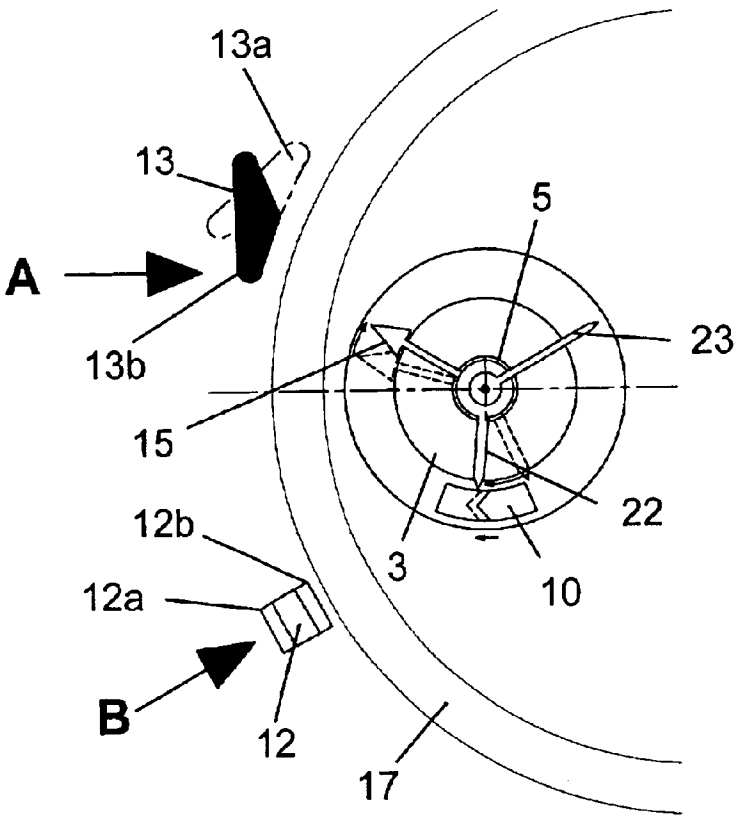

The world time watch further comprises for each one of the additional analogue time displays 5, an auxiliary setting device in the form of a pusher 12, which is also placed laterally on the housing 14 of the world time watch 1 and opposite of the corresponding auxiliary time display 5 or in the vicinity thereof. Such pushers with a corresponding pusher mechanism 104 are already known for example from chronographs and constitute movable members with its own compression spring which return automatically to the initial position 12*a* when released from its depressed position 12*b*. As can be seen in FIG. 10, each pusher includes due to safety reasons a pressure limit mechanism, which consists of a spring 48 and of a corresponding lever 47 and which requires a minimal pressure to be applied in order to be actuated, so that no modification of the time of the day or of the world location of an auxiliary time display 5 may occur in the case of an inadvertent impact either when the watch is carried or when it is put away. These pushers have two functions. On the one hand side, they allow, as the minute indication of the auxiliary time display 5 is done via the crown 11 by the main time display 4 as described above, the setting of the hour hand 22 of the auxiliary time display 5 independently of one another as well as of the minute hands 23 of the auxiliary time displays 5 and all the hands 19, 20, 21 of the main time display 4. As illustrated in the drawing 3*b*, the hour hand 22 and the day-night-indicator 10 are displaced synchronously by one hour by each operation on the pusher 12 corresponding to the desired auxiliary time display 5. On the other hand side and as illustrated in FIG. 3*a*, the actuation of a pusher 12 causes, after modification of the function of the pushers which will be described later in this document, the motion of the corresponding world location hand 15 by $1/24^{th}$ of a full rotation, resulting in that the world location hand 15, the hour hand 22 and the day-night-indicator 10 of an auxiliary time display 5 move simultaneously, whilst this action doesn't affect any of the other display members. Thus, it is possible to easily and rapidly set the indication of the world location and the corresponding time in the auxiliary time display 5 as in the case of the main time display 4.

In the case described here by way of example, this double function of the pushers 12 is possible due to the components of the world time watch illustrated in FIGS. 10 and 11. Firstly, an actuation of a pusher 12 results in the setting of the hour hand 22 of the corresponding auxiliary time display 5 via a pusher slide 43 which is moves together with the pusher 12 and the end of which co-operates with one end of the lever 47 in such a manner that a connecting part 74 mounted rotatably on its other end moves such as to rotate a ring 72 arranged co-axially with respect to the first click wheel 70 by a certain angle $\beta_1$ around its axis. This is schematically illustrated by arrows in FIG. 10*b*, in which, to facilitate the comprehension, the first position of the components is indicated by dashed dotted lines and the second position by continuous lines and in which the less important components of the gear train of the hour indication 101 are indicated only by dotted lines, and is represented in detail together with the correction mechanism 107 in FIG. 10*c*. As the ring 72 is provided with ring pawls 73 which may engage with a second click wheel 71, the latter also performs a rotation corresponding to that of the ring 72. The first click wheel 70, rigidly mounted on the second click wheel 71, engages by its teething with pawls 68 which are laterally urged against it by the above-mentioned springs 69, resulting in that the correction wheel 67, on which the pawls 68 are mounted movably, is rotated simultaneously, too. As can be seen from FIG. 10*a*, the correction wheel 67 drives the correction change wheel 66 and the hour change wheel 60, which in turn is engaged with the hour indication wheel 59. As was mentioned at the occasion of the explanation of FIG. 5, each hour wheel 58 of an auxiliary time display 5 is coupled by force-traction with the hour indication wheel 59 carrying the hour hand 22 of the auxiliary time display 5 by means of a coupling of the hour display 109. By surmounting the force exerted by the spring 65 on the pawl 64 of the coupling 109, this pawl 64 can be engaged in the neighbouring recess of the corresponding star 63 comprising twelve or twenty four teeth, which allows a relative rotation between the hour wheel 58 of an auxiliary time display 5 and the corresponding hour indication wheel 59 by an angle $\beta_2$ corresponding to an hour step. Thus, each operation on the pusher 12 of an auxiliary time display 5 advances the corresponding hour hand 22 by one hour. When the pusher 12 is released, the lever 47 and the pusher slide 43 return to the initial position due to the action of the spring 48, the lever spring 75 and the slide spring 99.

After a change of the pusher function which will be described further down in this document, the pusher 12 can also be used for the setting of the world location hand 15 of an auxiliary time display 5, as illustrated in FIGS. 11*a* and 11*b* by a schematic illustration of the movements involved and detailed cross section and plan views of the double coupling 108 of the correction wheel 67. This setting works the same way as described in the previous section, differs however in that it is not only the correction wheel 67 which is rotated by a pawl 68 mounted movably thereon, but also, by means of a friction spring 77, a friction wheel 76 arranged concentrically with respect to the correction wheel 67. This friction wheel has in each auxiliary time display 5 via a first intermediate world location wheel 78 and a second intermediate world location indication wheel 80 which is engaged with a world location indication wheel 80 for effect to bring about a rotation of the world location hand 15. This world location indication wheel 80 is equipped with a known star-pawl-coupling 110, which is analogous to the coupling of the hour display 109 described above, which comprises a pawl 82, a spring 83 and a star 81 with twenty four teeth and which thus allows to set the world location hand 15 by $1/24^{th}$-steps for a full rotation. Thus, while in the first operation mode of a pusher 12 it is only the hour hand 22 and the day-night-indicator 10 of the corresponding auxiliary time display 5 which are moved, the world location hand 15 is rotated, too, in the second mode.

Figure 8A:
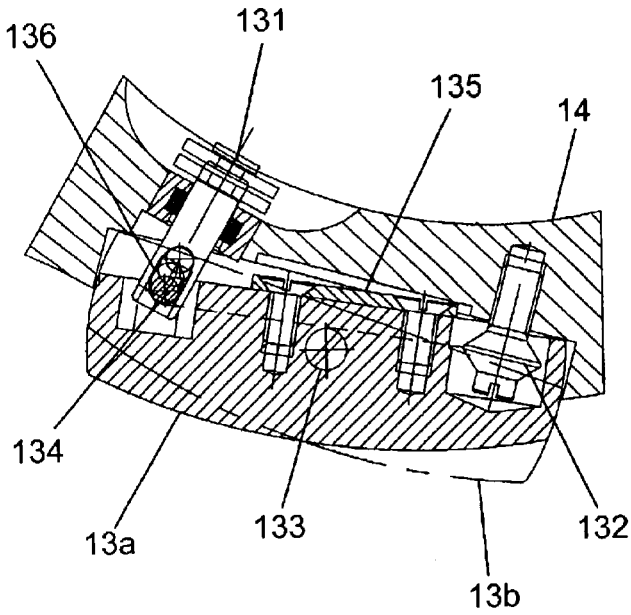
FIGS. 8*a–e* are cross-sectional views, taken longitudinally and transversally, of the commutator for selecting the functions of the pushers of the auxiliary displays.
Figure 8C:
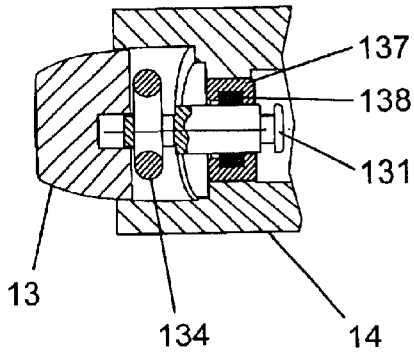
Figure 8D:
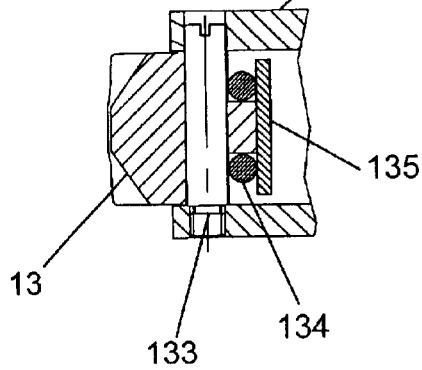
Figure 8B:
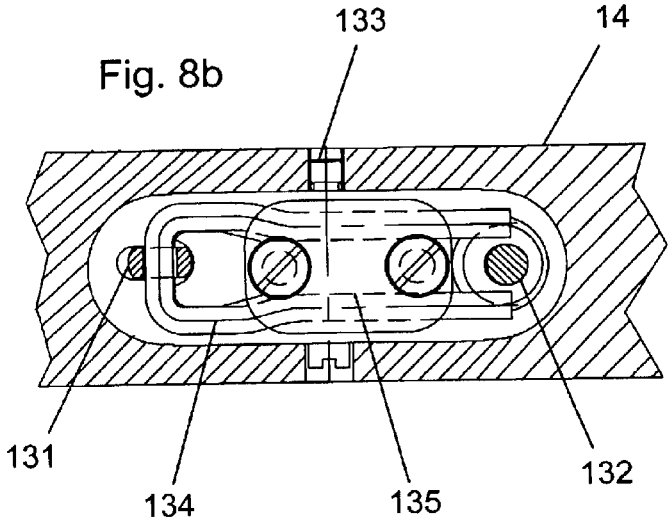
Figure 8E:
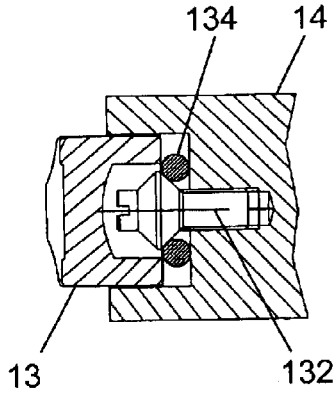

As it is apparent for instance from FIG. 1, the world time watch according to the present invention includes furthermore a special operating unit in the form of a commutator 13 for selecting the above-mentioned function of the pusher 12 for the auxiliary time displays 5. This commutator 13 may be realised, for example, as an engaging switch capable of assuming two positions 13*a* and 13*b*, wherein the part of the commutator protruding from the housing 14 indicates which function of the pusher 12 was selected. According to FIG. 3*a* the lower part of the commutator 13 is pressed for setting the world location hand 15 of an auxiliary time display 5 and, as shown in FIG. 3*b*, the upper part of the commutator 13 is depressed for setting the hour hand 22 of an auxiliary time display 5. Optionally, indices corresponding to these function can be provided on the housing 14 in the vicinity of the two ends of the commutator 13 or directly on the commutator 13. A preferred embodiment of such a commutator 13 is illustrated schematically in FIGS. 8*a–e*. A contact pin 131 capable of pivoting about its outwardly extending end and a stopper pin extending from the housing 14, for instance in the form of a so called stopper screw 132 screwed thereto, are housed, respectively, in two recesses on the inner side of the two ends of the commutator 13, and the commutator 13 itself is arranged in a lateral recess in the housing 14 of the world time watch 1 and is capable of pivoting about an axis located approximately in the middle of the commutator, that axis being for example realised by means of a pivot screw 133. The stopper screw 132 is adjustable by rotation, for example by means of a tool such as a screwdriver, in order to precisely adjust the position of the commutator 13, it has a portion shaped as a double cone frustum, and is housed in a corresponding recess in the housing 14 such that it may guide the commutator 13 in its switching movement to the two positions 13*a* and 13*b* by means of springs 134 and a small plate 135. The body or the head of the stopper screw is formed in such a manner that there are defined, in co-operation with the springs 134, two switch positions of the commutator 13, resulting in that the commutator 13 is bi-stable. When pressing the commutator 13, as illustrated in FIG. 8*e*, the two ends of the spring 134 arranged on the commutator 13 are sliding over the portion of the stopper screw 132 shaped as a double frustum, resulting in that a distinct clicking noise can be heard which confirms acoustically to the user that the commutator has been switched. As shown in FIG. 8*a*, the contact pin comprises a longitudinal bore 136 in which is located another spring 134 being arranged on the commutator 13 and which allows to adjust the lift of the contact pin 131 by varying the length of the bore. This contact pin 131 ensures the transmission of the force from the commutator 13 into the inside of the housing and co-operates with the components located inside the housing through a corresponding penetrating bore being provided in the housing 14 in which the contact pin 131 is guided by means of a sealing socket 137 and of an annular seal such as an O-ring 138 preventing simultaneously any ingress of water inside the housing. This cooperation which allows the choice of the pusher function mentioned above involves in addition to a lever mechanism 105 also a special blocking mechanism 106 and will now be described with reference to FIG. 11*a*. When setting the commutator 13 in its first position 13*a* by pushing on its upper end, it pushes the contact pin 131 into the corresponding bore. Thus, a lever slide 84 situated at the end of the contact pin transmits this motion to a lever rack 85 which is located on the other end of the lever slide and which is mounted pivotably at its end. The sector of that lever rack is engaged with a sector of a pivoting rack wheel 86, such that the rotational motion transmitted by the lever rack 85 will be transmitted by a second sector of the rack wheel 86 to an first intermediate rack wheel 87 and subsequently to a second intermediate rack wheel 88. The latter one is in engagement with a cam wheel 89 carrying a cam 90 which in turn, as a result of rotational motion it suffers, applies a force on a respective blocking lever 91 of each auxiliary time display 5. This force exceeds the one exerted by the return spring 92 of the blocking lever 91 on that latter, such that this blocking lever 91 is urged laterally against the corresponding world location indication wheel 80 and thus prevents its rotation. Thus, any modification of the setting of the world location hands 15 of the auxiliary time displays 5 is made impossible if the upper part of the commutator 13 is pressed to move that one in its position 13*a*. On the other hand side, if the lower part of the commutator 13 is pressed to move it into its second position 13*b*, the return spring 92 releases the blocking lever 91 from the world location indication wheel 80 and thus allows the setting of the world location hands 15.

The blocking mechanism 106 can also be actuated by exerting a traction on the crown 11, as it is apparent from FIGS. 12*a–b*. When a traction is exerted on the crown and therefore on the stem slide 41 and on the stem 42, an angled lever 33 which is pivotable about an axis situated approximately in its middle will be moved. That angled lever 33 on its turn acts on a control lever 32 which rotates by a certain angle a rack 97 which is engaged with the cam wheel 89, such that a second cam 98 urges the respective blocking lever 91 of an auxiliary time display 5 against the corresponding world location indication wheel 80. Thus, if the crown 11 is pulled into the first or the second pulled positions, any involuntary setting of the world location hands 15 is prevented, whereas the world location indication wheels 80 and thus the world location hands 15 can be moved due to the action of the return springs 92 on the blocking levers 91 if the crown 11 is in the rest position 11*a*.

Finally, the world time watch 1 comprises a control mechanism 30 which is illustrated with its main parts in FIG. 9 and which controls with respect to each other the functioning of the movable operating elements, namely the crown 11, the pushers 12 and the commutator 13, by its blocking or releasing in a manner transparent for the user, resulting in that any risk of damaging the watch or any inadvertent shift in one of the time displays 4, 5 due to simultaneous use of the crown 11 and of the pushers 12 is excluded. In FIGS. 2*a–c*, this effect of the control mechanism is illustrated schematically by means of arrows. If the crown 11 is in its rest position 11*a* to wind up the watch, the three pushers 12 as well as the commutator 13 can be used and thus the hour hands 22 and the world location hands 15 of the auxiliary time displays 5 can be set. However, should the crown 11 be in one of its pulled positions 11*b* or 11*c*, as illustrated schematically by crossed out arrows in FIGS. 2*b* and 2*c*, the pushers 12 cannot be used, such that any setting of the elements of the additional time displays 5 is excluded and only those setting operations corresponding to the position of the crown 11 may be effectuated, namely the hour setting by steps of one hour and the date setting of the main time display 4 in the first pulled position 11*b* of the crown 11 and the simultaneous setting of the hour hand 19 and of the minute hand 20 of the main time display 4 as well as of the hour hands 22 and of the minute hands 23 of the auxiliary time displays 5 in the second pulled position 11*c*. The commutator 13 can be operated in the pulled positions 11*b* and 11*c* of the crown 11, which however doesn't have any effect. On the other hand side, by pressing down at least one pusher 12 while the crown 11 in its rest position 11*a*, the crown 11 is blocked, such that the crown cannot be pulled if any one of the pushers 12 is operated and, thus the setting operations of the pushers 12 and of the crown 11 may neither be carried out simultaneously in this constellation. During the pushing, the commutator 13 may again be switched into its two positions 13*a* and 13*b* without however any effect. By releasing the operated pusher 12 or by returning the crown 11 into the rest position 11*a*, the respective blocking is cancelled.

This control of the operating elements can be achieved with the mechanism described in more detail in FIG. 9. In the exemplary embodiment illustrated, the main component of this control mechanism 30 is a control ring 31 which is positioned concentrically with respect to the centre 27 of the world time watch 1 and which co-operates by means of a rocking bar and a lever preferably being identical to the control lever 32 and angled lever 33 mentioned above with the stem slide 41 and the stem 42, thus with the crown 11, and which comprises on its outer side lateral recesses 34 facing the pushers 12. Depending of the engagement position of the crown 11, the ring 31 and its recesses 34 occupies, as schematically indicated in FIG. 9 by an arrow, due to the action of the angled lever 33 at least two radial positions 31*a* and 31*b*. The first position 31*a* corresponds to the rest position 11*a* and the second position 31*b* corresponds to the pulled positions 11*b* or 11*c* of the crown 11. Furthermore, the pushers 12 comprise each a pusher slide 43 which is adapted to assume two positions 43*a* and 43*b* and which has a pin 44 fastened thereto which, during the operation of the pusher 12, can be shifted into the recess 34 of the ring 31 situated opposite to it if the crown 11 is in its rest position 11*a*, as the recesses 34 are in that case situated opposite the pins 44. In the pulled positions 11*b* and 11*c* of the crown 11 this is not the case, such that the pushers 12 are blocked if tried to be operated due to the stroking of the pins 44 against the outer edge of the ring 31. Analogously, if a pusher 12 is operated during the crown 11 being in the rest position 11*a*, the corresponding pin 44 is moved into the recess 34 facing it and the ring 31 cannot be rotated any more, as shown in a zoomed view of FIG. 9 by a zigzag shaped arrow, resulting in that this prevents the crown from being pulled. Thus, a simple and effective control of the operating elements crown 11 and pushers 12 with respect to each other is provided.

Even without this having been mentioned due to the large number of components each time in the different sections of the description, the individual mechanical components as well as their practical arrangement are not limited to the embodiments described, but may be replaced by components fulfilling the same functions, without departing from the scope or the spirit of the present invention as disclosed. Thus, the described embodiment of a world time watch according the present invention doesn't have to be interpreted in any limiting manner.

Accordingly, the detailed conception of the operating unit 13 for choosing the two functions of the pushers 12 may vary within the scope of the inventive idea of the present invention. For example, the commutator 13 can be replaced by one or two buttons next to each other, which also visually and/or acoustically confirm the switching of the function of the pushers 12 realised by its operation.

In particular, another embodiment of the world time watch may be realised which does not indicate a world location 6 corresponding to the time zone the time of the day of which is given in an auxiliary time display 5, such that the double function of the auxiliary setting devices 12 and, accordingly, the need for the operating unit 13 for the choice of the function are suppressed. Nevertheless, the control mechanism 30 for controlling with respect to each other the functions of the main setting device 11 and of the auxiliary setting devices 12 still is a simple and effective means for improving the operating functions and thus still constitutes an important component of such a watch.

Analogously, it would be possible to suppress the control mechanism 30 in a world time watch comprising the above described indication of a corresponding world location 6 for the time indicated by the auxiliary time displays 5, for instance in order to reduce the manufacturing costs. The operating unit 13 still present in such a watch allows for the choice of the function of the auxiliary setting devices 12, independently of the control of its operation with regard to the operation of the main setting device 11.

The previously described embodiments of the world time watch according to the present invention illustrate the framework with regard to the inventive concept for various modifications and variations, which could be applied to a world time watch according to the present invention; due to the high number of components the modifications of the individual parts will not be described in detail, without this to be interpreted in any limiting manner.

The main components of the present invention described up to now by means of the exemplary case of a world time watch, in particular a control mechanism for the co-ordination of the functions and of the operation of the main and of the auxiliary setting device(s) of a watch and an operating unit for choosing the function of a setting device of a watch, may obviously also be used in watches of another type, which however comprises the same necessities and the same requirements on such components as the world time watch disclosed before. Thus, these components also have to be regarded individually with respect to its caracteristics. In general, these two components according to the present invention may be used in any watch with at least one auxiliary setting device and a main setting device which comprises at least two engagement positions, namely a rest position and at least one pulled position.

Thus, it is possible to use the control mechanism mentioned above in a conventional—like in the case of a world time watch—usually analogue or also digital chronograph. In such a case, the chronograph usually includes a chronograph display incorporated either into its main time display or into a separate auxiliary time display which is equipped in most of the cases with one or two additional chronograph or stopper hands for measuring the time. Thus, such a chronograph usually includes a main setting device with at least two engagement positions for setting the main time display and at least one auxiliary setting device for the chronograph display or its hands. The co-ordination of its functions, which obviously differ from the ones of the setting devices of a world time watch, can nevertheless be done by using the same principle and exactly the same means as described above, namely the control mechanism described in detail above.

The same is also valid for the operating unit for choosing the function of a setting device of a watch, shall it be realised in the form of a commutator, of a button or similar, which may be used in all watches comprising setting devices with at least two different corresponding functions.

Thus, the framework of the inventive idea of the present invention incorporates the two basic elements of the invention per se, namely the control mechanism for the co-ordination of the functions and of the operation of the main and of the auxiliary setting device(s) of a watch and the operating unit for choosing the function of a setting device of a watch, as well as the combination of these devices with a watch of any type suitable for the integration of these components.

What is claimed is:

1. A control mechanism (30) adapted to be incorporated into a watch with a main setting device (11), which comprises at least two engagement positions (11*a–c*), namely a rest position (11*a*) and at least one pulled position (11*b*, 11*c*), and with at least one auxiliary setting device (12), the control mechanism (30) allowing to control with respect to each other the main setting device (11) and the auxiliary setting devices (12) in such a manner that the functions of the main setting device (11), with the exception of the rewinding of the watch in the rest position (11*a*), cannot be carried out at the same time as those of the auxiliary setting devices (12).

2. A control mechanism (30) according to claim 1, the main component of the control mechanism (30) being a control ring (31) which is placed concentrically with respect to the centre (27) of the watch (1).

3. A control mechanism (30) according to claim 2, the control ring (31) being adapted to assume at least two different radial positions (31*a*,31*b*).

4. A control mechanism (30) according to claim 2, the control ring (31) co-operating via a control lever (32) and an angled lever (33) with a stem slide (41) and a stem (42) being part of the main setting device (11), that ring comprising on its outer edge lateral recesses (34) facing the auxiliary setting devices (12), such that, depending on the engagement position of the main setting device (11), the ring (31) with its recesses (34) may assume due to the action of the angled lever (33) at least two different radial positions (31*a*,31*b*), the first position (31*a*) corresponding to the rest position (11*a*) and the second position (31*b*) corresponding to the pulled positions (11*b*,11*c*) of the main setting device (11).

5. A control mechanism (30) according to claim 4, a pin (44) being fixed to a pusher slide (43) of each auxiliary setting device (12), said slide being capable of assuming two positions (43*a*,43*b*), being adapted to be shifted into the facing recess (34) of the ring (31) by operation of the auxiliary setting device (12) if the main setting device (11) is in its rest position (11*a*) and thus the recesses (34) are situated opposite the pins (44), whereas this is not the case in the pulled positions (11*b*,11*c*) of the main setting device (11), such that in these positions the auxiliary setting devices (12) are blocked with respect to their operation due to the stroking of the pins (44) against the outer edge of the ring (31) and that, during operation of an auxiliary setting device (12) if the main setting device (11) is in its rest position (11*a*), the corresponding pin (44) is moved into the recess (34) of the ring (31) facing it and thus that latter one cannot be rotated during the actuation of the auxiliary setting device (12), which results in the blocking of the main setting device (11) with regard to the execution of one of its functions in a pulled position (11*b*,11*c*).

6. A watch with a main setting device (11) comprising at least two engagement positions (11*a–c*), namely one rest position (11*a*) and at least one pulled position (11*b*,11*c*), and with at least one auxiliary setting device (12), that watch comprising a control mechanism (30) according to claim 1.

7. A watch according to claim 6, the watch being in particular a chronograph with a chronograph indicator incorporated in the main time display (4) or in a separate auxiliary time display (5) and comprising a main setting device (11) with at least two engagement positions (11*a–c*) and at least one auxiliary setting device (12) corresponding to the chronograph indicator.

8. A watch according to claim 6, the watch being in particular a world time watch with an analogue main time display (4) and at least one analogue auxiliary time display (5) and comprising for each one of these auxiliary time displays (5) an auxiliary setting device (12) for setting its time independently of all the other displays and a main setting device (11) protruding from the outer side of the housing (14) with three engagement positions (11*a–c*), namely one rest position (11*a*) and two pulled positions (11*b*,11*c*).

9. A watch according to claim 6, the auxiliary setting device (12) being realized as a pusher (12) which is placed laterally on the housing (14) of the watch (1) and is facing or is in the vicinity of the corresponding auxiliary time display (5).

10. A watch according to claim 9, each pusher (12) comprising two positions (12*a*,12*b*) and a pressure limit mechanism comprising a spring (48) and a corresponding lever (47), such that, after release of a pusher (12) from its depressed position (12*b*), it automatically returns into its initial position (12*a*) and that the application of a minimal pressure is necessary for the operation of the pusher.

11. A watch according to claim 8, the operation of an auxiliary setting device (12) resulting in the setting of an hour hand (22) carried by an hour indication wheel (59) of the corresponding auxiliary time display (5) of the world time watch by hour steps.

12. A watch according to claim 11, the setting of the hour hand (22) of an auxiliary time display (5) being achieved by means of a pusher slide (43) movable with the auxiliary setting device (12), the end of that pusher slide co-operating with one end of a lever (47) in such a manner, that a connecting element (74) mounted rotatably at its other end is moved such as to rotate a ring (72) being placed coaxially with respect to a first click wheel (70) by a certain angle ($\beta_1$) about its axis, such that, due to the fact that the ring (72) is provided with ring paw is (73) which can engage with a second click wheel (71), the latter performs a rotation corresponding to the one of the ring (72), and that the first click wheel (70) which is fixed to the second click wheel (71) engages by its teeth with pawls (68) which are urged laterally against it due to the action of the springs (69), such that a correction mechanism (107) effectuates the displacement of the hour hand (22) of the corresponding auxiliary time display (5) by one hour.

13. A watch according to claim 12, the correction mechanism (107) comprising a correction wheel (67) which performs a rotation corresponding to the one of the first click wheel (70) due to the engagement of the first click wheel (70) with said pawls (68) mounted movably on the correction wheel (67), the correction wheel (67) acting on a correction change wheel (66) and an hour change wheel (60) which in turn is engaged with an hour indication wheel (59), and an hour wheel (58) of an auxiliary time display (5) being force coupled by means of a coupling of the hour indication (109) with the hour indication wheel (59) carrying the hour hand (22) of the auxiliary time display (5), such that by exceeding the force exerted by a spring (65) on a pawl (64) of this coupling (109) this pawl (64) engages with a subsequent recess of a corresponding star (63) carrying twelve or twenty four teeth and thus produces a relative rotation between the hour wheel (58) of an auxiliary time display (5) and the corresponding hour indication wheel (59) by an angle ($\beta_2$) corresponding to an hour step, each operation of an auxiliary setting device (12) of an auxiliary time display (5) thus advancing the corresponding hour hand (22) by one hour.

14. A watch according to claim 8, the watch comprising for each of the auxiliary time displays (5) an analogue indication (15,18) of a world location (6) corresponding to the indicated time zone.

15. A watch according to claim 8, the main setting device being realized as a crown (11), the non-pulled rest position (11*a*) of which being used, in the case of a mechanical clockwork-movement, for winding up the watch, its first pulled position (11*b*) allowing for the correction of the hour indication and of a date indicator (7) of the main time display (4) by hour steps in both directions of rotation, an hour hand (19) of the main time display (4) performing a full rotation in twelve steps independently of the minute hand (20) of the main time display (4) and a forward-backward movement of the hour hand (19) of the main time display (4) around the 12-o'clock position with the crown (11) being in said first pulled position resulting in an incremental switching of the date indicator (7), and its second pulled position (11*c*) allowing the setting of the main time display (4), a rotation of the crown (11) in this position resulting, again in both directions of rotation, in a synchronized movement of the hour hands (19,22) and of the minute hands (20,23) of all time displays (4,5).

16. A watch according to claim 15, in which pulling the crown (11) operates a blocking mechanism (106), which allows to prevent the displacement of a world location hand (15) placed on a world location indication wheel (80) of each auxiliary time display (5) in a pulled position (11*b*,11*c*) of the crown.

17. A watch according to claim 16, said blocking mechanism (106) comprising a stem slide (41) and a stem (42) being operated by traction applied by the crown, such that an angled lever (33) mounted pivotably about an axis situated approximately in its middle is moved and acts on a control lever (32), which produces a rotation about a certain angle of a rack (97) engaged with a cam wheel (89), resulting in that a second cam (98) laterally urges a respective blocking lever (91) of an auxiliary time display (5) against the world location indication wheel (80) corresponding to that auxiliary time display, thus preventing any displacement of the world location hand (15) placed on the world location indication wheel (80) in the first and second pulled positions (11*b*,11*c*) of the crown (11), whereas the world location indication wheel (80) and thus the world location hand (15) can be moved due to the action of a return spring (92) on the blocking lever (91) in the rest position (11*a*) of the crown (11).

18. A watch according to claim 8, the auxiliary time displays (5) each including a day-night-indicator (10) rotating synchronously with respect to an hour hand (22) of the corresponding auxiliary time display (5).

19. A watch according to claim 8, at least one auxiliary time display (5) being adapted to indicate the time of the day in the existing half an hour time zones.

* * * * *